US005556291A

United States Patent [19]

Ito

[11] Patent Number: 5,556,291

[45] Date of Patent: Sep. 17, 1996

[54] JOINT CONNECTOR

[75] Inventor: Osamu Ito, Yokkaichi, Japan

[73] Assignee: Sumitomo Wiring Systems, Ltd., Mie, Japan

[21] Appl. No.: 240,550

[22] Filed: May 11, 1994

[30] Foreign Application Priority Data

May 14, 1993 [JP] Japan ..... 5-136849

[51] Int. Cl.[6] ..... H01R 29/00

[52] U.S. Cl. ..... 439/189; 439/752

[58] Field of Search ..... 439/188, 189, 439/595, 752

[56] References Cited

U.S. PATENT DOCUMENTS 4,952,155 8/1990 Kuzuno et al. .
5,106,318 4/1992 Endo et al. .
5,112,239 5/1992 Yagi et al. .
5,201,667 4/1993 Endo et al. .
5,308,265 5/1994 Kaneko ..... 439/752
5,326,275 7/1994 Murakami ..... 439/189

FOREIGN PATENT DOCUMENTS 61-277180 12/1986 Japan .

*Primary Examiner*—Khiem Nguyen
*Attorney, Agent, or Firm*—Oliff & Berridge

[57] ABSTRACT

A joint connector for connecting a plurality of wires has terminals holding the respective wires, and a connector housing. The connector housing includes terminal receiving chambers for receiving the respective terminals, and a retainer. The retainer is abutted against the terminals to retain the terminals in their respective predetermined positions, the retainer having a retainer body and a joint member mounted on the retainer body for electrically short-circuiting the terminals which are desired to connect together.

13 Claims, 3 Drawing Sheets

JOINT CONNECTOR

BACKGROUND OF THE INVENTION

This invention relates to a joint connector for connecting a plurality of connection wires together.

One known joint connector of the type described is disclosed in Japanese Patent Unexamined Publication No. 61-277180.

In the joint connector described in this publication, front end portions of wires to which female terminals are connected, respectively, are received in a connector housing having a plurality of terminal receiving chambers. A plurality of male terminals for being inserted respectively into the female terminals provided respectively in the terminal receiving chambers are provided in a housing body for receiving the connector housing. The male terminals are connected together in a manner corresponding to the female terminals to be electrically connected together.

In this construction, the female terminals are connected respectively to the front end portions of the connection wires to be connected together, and are received respectively in the terminal receiving chambers of the connector housing. And thereafter when this connector housing is inserted into the housing body, the male terminals in the housing are fitted in and connected to their mating female terminals, respectively, so that the plurality of wires are electrically connected together through the male terminals.

In the above conventional joint connector, there has been encountered a problem that the housing body separate from the connector housing must be provided.

The present invention has been made in view of the above problem, and an object of the invention is to provide a joint connector in which predetermined connection wires can be connected together only by means of a connector housing.

SUMMARY OF THE INVENTION

In order to achieve the above mentioned object, a joint connector according to the present invention for connecting a plurality of wires has terminals holding the respective wires, and a connector housing. The connector housing includes terminal receiving chambers for receiving the respective terminals, and a retainer. The retainer is abutted against the terminals to retain the terminals in their respective predetermined positions, the retainer having a retainer body and a joint member mounted on the retainer body for electrically short-circuiting the terminals which are desired to connect together.

In the joint connector described above, the retainer is provided with the joint member, and therefore when the retainer is abutted against the terminals, the joint member short-circuits the terminals, so that connection wires connected respectively to these terminals are electrically connected together.

As described above, in the present invention, the retainer of the connector housing has the joint member, and therefore there can be provided the joint connector which does not require a separate housing body.

Moreover, if this construction is used in one of ordinary connectors, this connector can perform the function of a joint connector since the retainer merely holds the terminals, and also this connector can be fittingly connected to the other connector, and therefore various branch circuits can be formed.

DETAILED DESCRIPTION OF THE PREFERRED EMBODIMENTS

A preferred embodiment of the present invention will now be described with reference to the drawings.

Figure 1:
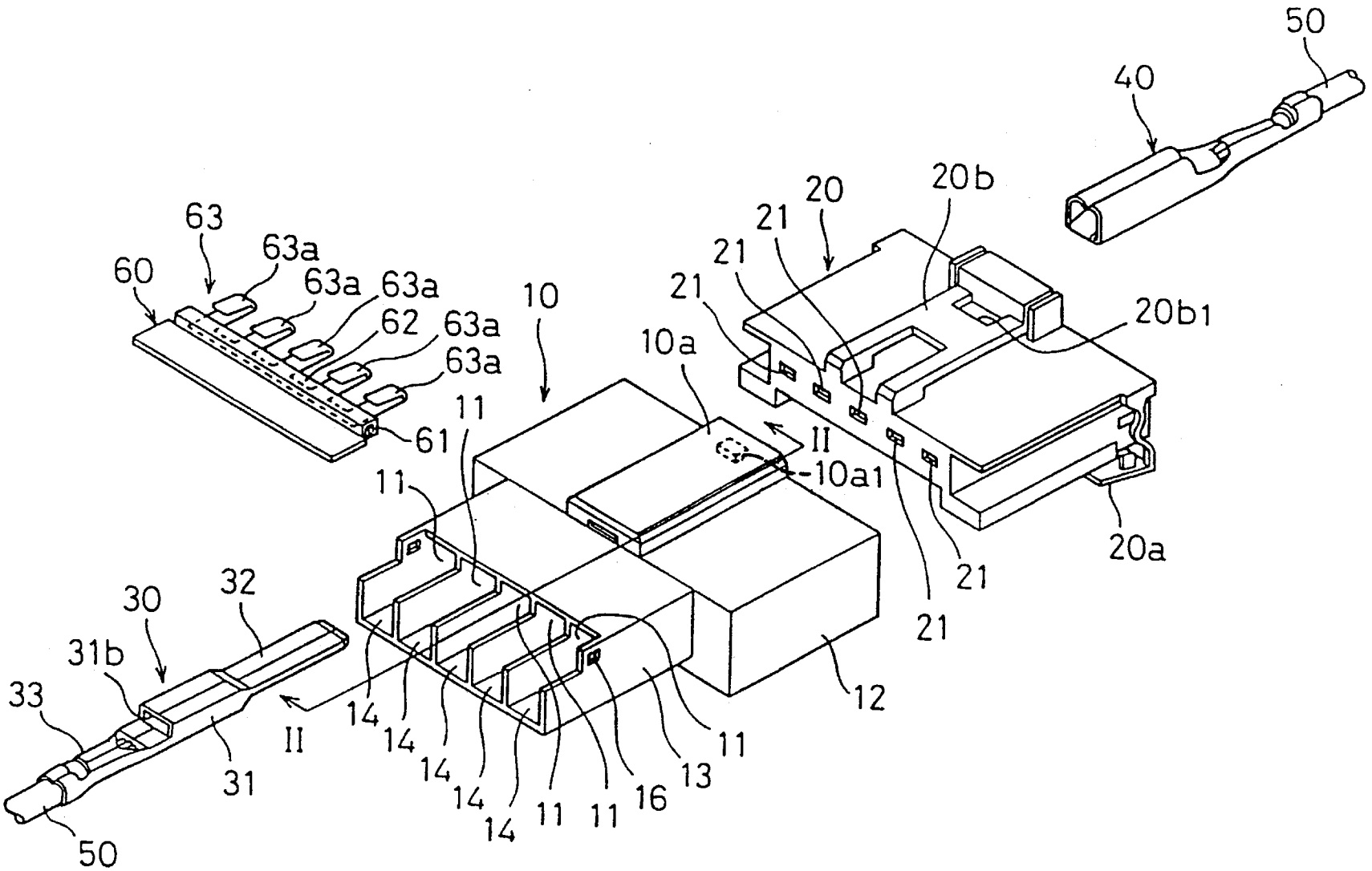
FIG. 1 is an exploded perspective view of one preferred embodiment of a joint connector of the present invention.
Figure 2:
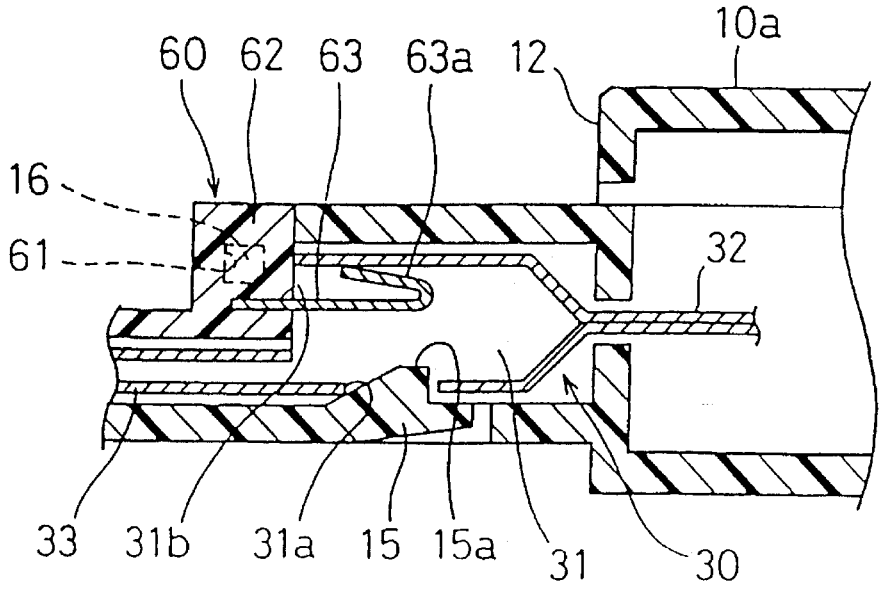
FIG. 2 is a cross-sectional view of a portion taken along the line II—II of FIG. 1.

FIG. 1 is an exploded, perspective view of a joint connector of the present invention, and FIG. 2 is a cross-sectional view of a portion thereof.

In the drawings, a male connector housing 10 and a female connector housing 20 have five terminal receiving chambers 11 and five terminal receiving chambers 21, respectively, and male terminals 30 are received in the terminal receiving chambers 11, respectively, whereas female terminals 40 are received in the terminal receiving chambers 21, respectively. The female connector housing 20 is inserted into a hood portion 12 of the male connector housing 10, so that the male terminals 30 are fitted in and connected to their mating female terminals 40, respectively.

The male connector housing 10 has a terminal holding portion 13. The interior of the terminal holding portion 13 is divided into the five terminal receiving chambers 11. The hood portion 12 is provided forwardly of the terminal holding portion 13, and terminal insertion ports 14 are provided rearwardly of this terminal holding portion. An elastic lock piece 15 is formed on a bottom wall of each terminal receiving chamber 11, and has a lock pawl **15*a*** disposed within the terminal receiving chamber.

The male terminal 30 includes a tubular barrel portion 31 of a square cross-section intermediate opposite ends thereof, a terminal portion 32 extending forwardly from this barrel portion, and a barrel portion 33 disposed rearwardly of the barrel portion 31 for being connected to a connection wire 50. A lock hole **31*a* in which the lock pawl 15*a* is engageable is formed through that portion of the bottom wall of the barrel portion 31 with which the lock pawl 15*a* can be disposed in registry. An open end 31*b* of the barrel portion 31 in the form of a square tube is disposed on an upper side of a connection portion interconnecting the barrel portion 31 and the barrel portion 33**.

A rear portion of the terminal holding portion 13 of the male connector housing 10 is open at its upper side, and a retainer 60 is provided to cover this opening. The retainer 60 is shaped in the form of a plate has projections 61 at its opposite sides, and the retainer 60 is retained in a manner to cover the opening of the male connector housing 10, with the projections 61 engaged respectively in engagement holes 16 formed respectively in opposite side walls of the male connector housing 10. The retainer 60 has an abutment wall 62 at its front side, and the abutment wall 62 is abutted against the open ends **31*b* of the male terminals 30, received in the respective terminal receiving chambers 11**, from the rear side.

A bus bar 63 of metal is fixedly mounted on the abutment wall 62 of the retainer 60, and has tab-like contact terminals **63*a* extending respectively into the terminal receiving chambers 11. A front portion of each contact terminal 63***a* of the bus bar 63 is folded back upwardly to have a spring nature, and the contact terminal 63*a* extends into a respective one of the terminal receiving chambers 11. Simultaneously, the contact terminal 63*a* also extends through the open end 31*b* into the barrel portion 31, and, due to its resilient nature, is contacted with an inner surface of an upper wall of the barrel portion 31 under a predetermined pressure. In this embodiment, one contact terminal 63*a* is provided for each of the five terminal receiving chambers 11, and all of the contact terminals 63*a* are electrically connected together, thus forming the single bus bar 63. The bus bar 63 constitutes a metal joint member.

The female connector housing 20 has the terminal receiving chambers 21 for respectively receiving and holding the female terminals 40, and also has a retainer portion 20*a* integrally formed therewith for retaining the inserted female terminals 40 in position.

An elastic engagement piece 20*b*, which can be flexed upwardly and downwardly, is formed on an upper surface of the female connector housing 20. An engagement cover 10*a* for receiving the engagement piece 20*b* is formed on an upper surface of the male connector housing 10 at a position corresponding to the engagement piece 20*b*. An engagement hole 20*b*1 is formed in an upper surface of the engagement piece 20*b*, and a projection 10*a*1 for engagement in the engagement hole 20*b*1 is formed on an inner surface of an upper wall of the engagement cover 10*a*.

The operation of this embodiment of the above construction will now be described.

Here, the five connection wires 50 are to be electrically connected together. The front end portion of the connection wire 50 is fixedly secured to the barrel portion 33 of the male terminal 30 by compressive clamping, and each male terminal 30 is inserted into the terminal receiving chamber 11 through the terminal insertion port 14. As the male terminal 30 is inserted, the front end of the barrel portion 31 abuts against the lock pawl 15*a* of the lock piece 15 to urge this lock pawl 15*a* downwardly. Then, when the male terminal 30 is further inserted into a predetermined position within the terminal receiving chamber 11, the lock pawl 15*a* becomes received and engaged in the lock hole 31*a*, so that the male terminal 30 is retained in this position.

After all of the five male terminals 30 are inserted in the above manner, the retainer 60 is attached relative to the upper opening provided at the rear portions of the terminal receiving chambers 11. At this time, the contact terminals 63*a* of the bus bar 63 are introduced respectively into the terminal receiving chambers 11, and are further inserted respectively into the open end portions 31*b* of the male terminals 30 held respectively in the terminal receiving chambers 11.

The projections 61 formed respectively on the opposite sides of the retainer 60 are engaged respectively in the engagement holes 16 formed in the male connector housing 10 as shown in FIG. 2. And in this condition the abutment wall 62 of the retainer 60 is abutted against the upper portion of the rear end of the barrel portion 31 of each male terminal 30, and the retainer 60 covers the upper opening of the terminal receiving chambers 11. Thus, the retainer 60 is retained in such a manner that the male terminals 30 are prevented from being displaced rearwardly and upwardly.

On the other hand, the contact terminals 63*a* of the bus bar 63 are inserted respectively into the barrel portions 31, and are contacted therewith. Since the contact terminals 63*a* are contacted respectively with the male terminals 30 within the respective terminal receiving chambers 11, the connection wires 50 connected respectively to the male terminals 30 are electrically connected together.

Figure 3:
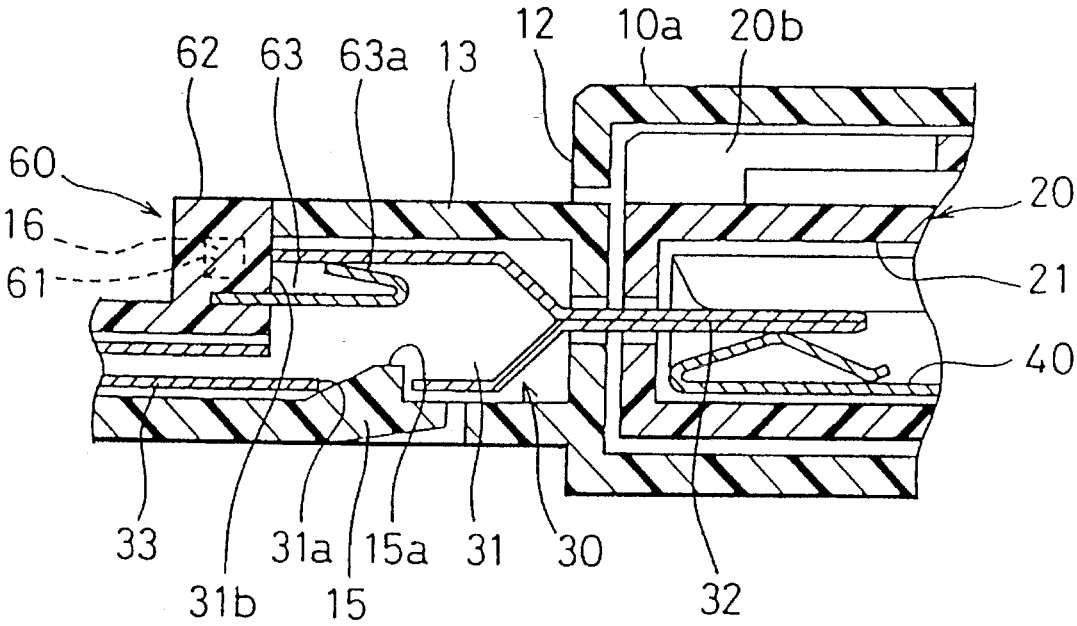
FIG. 3 is a cross-sectional view of a portion taken along the line II—II of FIG. 1, showing a fitted condition of the connector.

A connection wire 50 is also connected to each female terminal 40, and the female terminal is inserted into the terminal receiving chamber 21 of the female connector housing 20, and the retainer portion 20*a* is attached. When the female connector housing 20 is inserted into the hood portion 12 of the male connector housing 10, the terminal portion 32 of each male terminal 30 extending from the terminal receiving chamber 11 into the hood portion 12 is inserted into an open portion of the corresponding female terminal 40, thereby electrically connecting the male and female terminals together, as shown in FIG. 3. In this case, the bus bar 63 is contacted only with the barrel portions 31 of the male terminals 30, and therefore the female connector housing 20, which is the mating housing for the male connector housing, can be connected thereto in an ordinary manner. As a result, all of the terminals received in the male and female connector housings 10 and 20 are electrically connected together through the bus bar 63.

When the female connector housing 20 is inserted into the male connector housing 10, the engagement piece 20*b* formed on the upper surface of the female connector housing 20 is inserted into the engagement cover 10*a* formed on the upper surface of the male connector housing 10, and the projection 10*a*1 is engaged in the engagement hole 20*b*1, thereby preventing the two connector housings 10 and 20 from being disengaged from each other.

Figure 4:
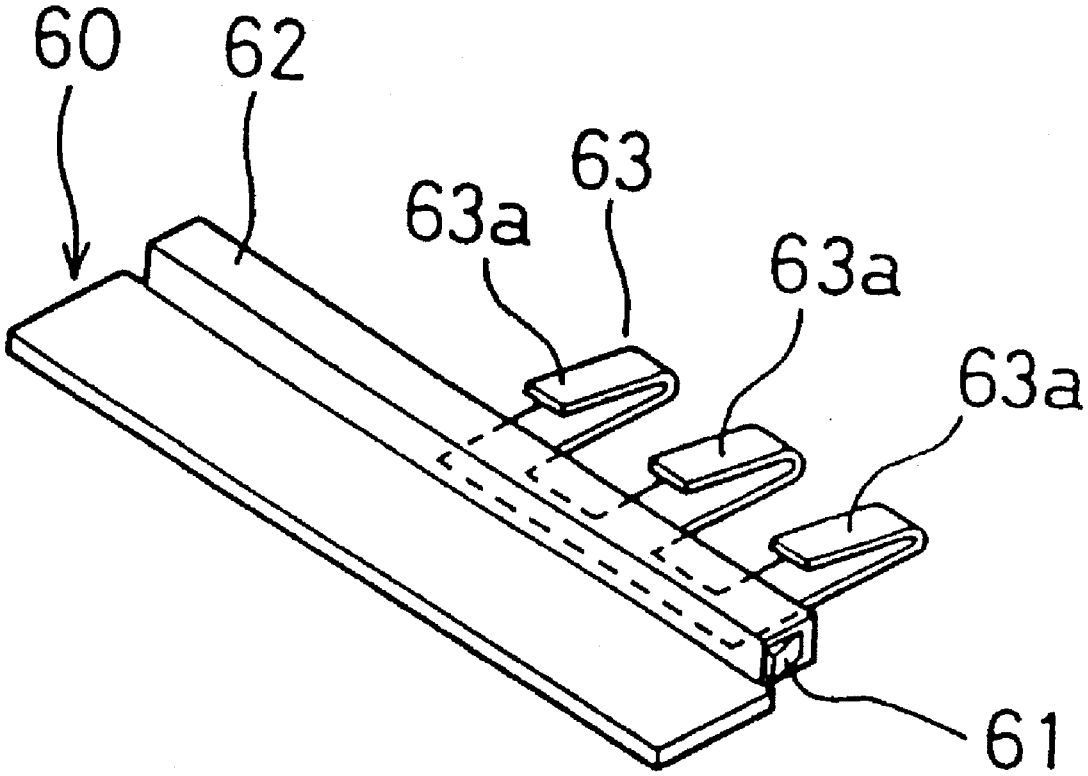
FIG. 4 is a perspective view of a modified bus bar.

In the above embodiment, although all of the male terminals 30 received respectively in the terminal receiving chambers 11 are electrically connected together, a desired number of male terminals 30 may be connected together by reducing the number of contact terminals 63*a* of a bus bar 63, as shown in FIG. 4.

The retainer 60 can be attached to the male connector housing 10 regardless of whether or not the bus bar 63 is mounted on the retainer 60. In the case where the bus bar is not mounted on the retainer, the male terminals 30 can not be connected together, but the male connector of an ordinary type can be provided.

Thus, the retainer for abutting against the terminals, received in the connector housing, to retain them in position, are originally designed to abut against these terminals, and merely by mounting the bus bar (metal joint member for contact with the terminals) on the retainer, the connection terminals can be connected together without the need for a housing which has heretofore been used only for joint purposes.

What is claimed is:

1. A joint connector for connecting a plurality of wires, the joint connector comprising:

terminals holding the respective wires; and a connector housing including;

terminal receiving chambers for receiving the respective terminals, and a retainer being abutted against said terminals to retain said terminals in their respective predetermined positions, said retainer having a retainer body and a joint member comprising a resilient portion, said joint member mounted on said retainer body for resiliently contacting and electrically short-circuiting predetermined ones of said terminals.

2. A joint connector according to claim 1, wherein each of said terminals has an open end;

said resilient portion of said joint member includes contact terminals for electrically connecting said predetermined ones of said terminals which are desired to connect together; and said contact terminals are inserted into the respective open ends of said predetermined ones of said terminals.

3. A joint connector according to claim 1, wherein said retainer body is in the form of a plate.

4. A joint connector according to claim 1, wherein each of said terminals comprise a generally square shaped cross-sectional barrel portion.

5. A joint connector according to claim 4, wherein each of said terminals further comprises an elongated terminal portion extending from the generally square shaped cross-sectional barrel portion.

6. A joint connector according to claim 4, wherein each of said terminals includes a lock hole on a bottom wall of the generally square shaped cross-sectional barrel portion.

7. A joint connector according to claim 6, wherein said connector housing further includes a lock pawl within said terminal receiving chamber, said lock pawl being configured to cooperate with said lock hole to retain each of said terminals within said terminal receiving chamber.

8. A joint connector according to claim 1, wherein said resilient portion of said joint member extends away from said retainer body and is bent back on itself.

9. A joint connector according to claim 8, wherein the retainer body is in the form of a plate and said resilient portion of the joint member extends away from said plate member and is bent back on itself.

10. A joint connector according to claim 1 wherein said resilient portion of said joint member contacts said predetermined ones of said terminals with a predetermined pressure.

11. A joint connector according to claim 1 wherein the connector housing is a first connector housing and the joint connector further comprises a second connector housing connectable to the first connector housing.

12. A joint connector according to claim 11, wherein one of said first and second connector housings include one of a projection and engagement piece and the other of said first and second connector housing comprise the other of said projection and engagement piece.

13. A joint connector according to claim 12, wherein the first connector housing comprises said projection and the second housing comprises said engagement piece.

* * * * *